US005421668A

United States Patent [19]

Cowan et al.

[11] Patent Number: 5,421,668

[45] Date of Patent: Jun. 6, 1995

[54] TREAD BALLAST OR WEIGHT FOR TEMPORARY TRAFFIC CONTROL DEVICES AND POSTS

[75] Inventors: David E. Cowan, Cleveland Heights; David A. Cowan, Pepper Pike, both of Ohio

[73] Assignee: Plastic Safety Systems, Inc., Cleveland, Ohio

[21] Appl. No.: 266,486

[22] Filed: Jun. 27, 1994

[51] Int. Cl.[6] ..... E01F 9/00

[52] U.S. Cl. ..... 404/6; 256/13.1

[58] Field of Search ..... 404/6, 9, 10; 256/1, 256/13.1

[56] References Cited

U.S. PATENT DOCUMENTS

| | | | |
|---|---|---|---|
| 2,719,505 | 10/1955 | Blumenthal . | |
| 3,099,244 | 7/1963 | Knapp . | |
| 3,451,368 | 6/1969 | Keats . | |
| 3,475,009 | 10/1969 | Brown . | |
| 3,692,281 | 9/1972 | Clayton . | |
| 3,848,853 | 11/1974 | Uay et al. . | |
| 4,021,020 | 5/1977 | Decker . | |
| 4,083,033 | 4/1978 | Kulp et al. . | |
| 4,122,795 | 10/1978 | Doring | 256/1 X |
| 4,157,210 | 6/1979 | Mesman . | |
| 4,312,600 | 1/1982 | Schaaf et al. . | |
| 4,925,334 | 5/1990 | Beard . | |
| 5,036,791 | 8/1991 | Thurston . | |
| 5,156,486 | 10/1992 | Davidson . | |
| 5,199,813 | 4/1993 | Nagler . | |
| 5,215,399 | 6/1993 | Berger . | |
| 5,234,280 | 8/1993 | Cowan . | |
| 5,284,326 | 2/1994 | Chiovitti et al. | 256/13.1 |

FOREIGN PATENT DOCUMENTS

| | | |
|---|---|---|
| 2122239 | 1/1984 | United Kingdom . |
| 2125863 | 3/1984 | United Kingdom . |

*Primary Examiner*—William P. Neuder

*Attorney, Agent, or Firm*—Renner, Otto, Boisselle & Sklar

[57] ABSTRACT

A weight or ballast for a temporary traffic control device or post is made of one or more tire tread sections. An opening extending through or formed by the tread sections is sized to receive an upstanding portion of the device or post.

26 Claims, 2 Drawing Sheets

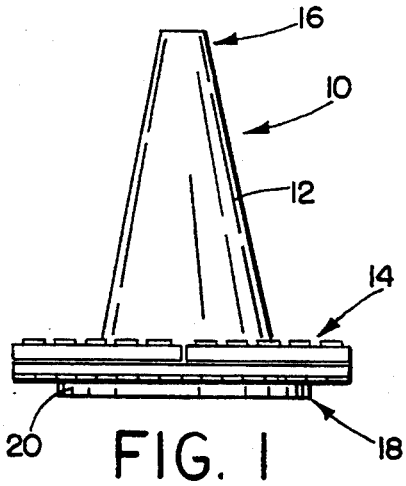
FIG. 1
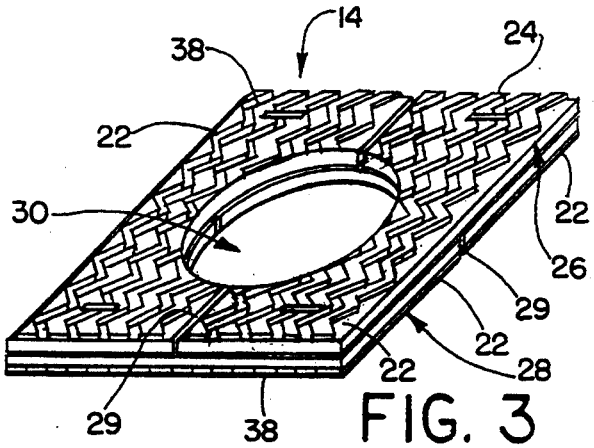
FIG. 3
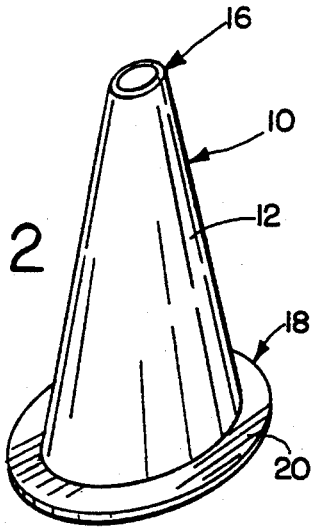
FIG. 2
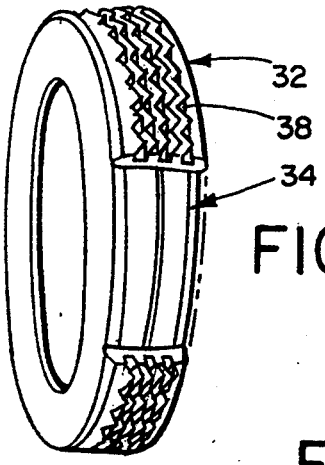
FIG. 4A
FIG. 4B
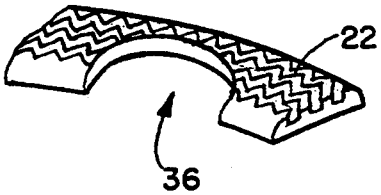
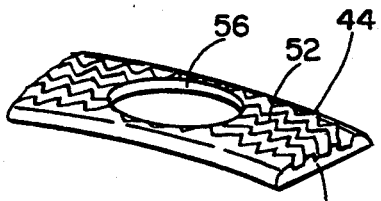
FIG. 6A
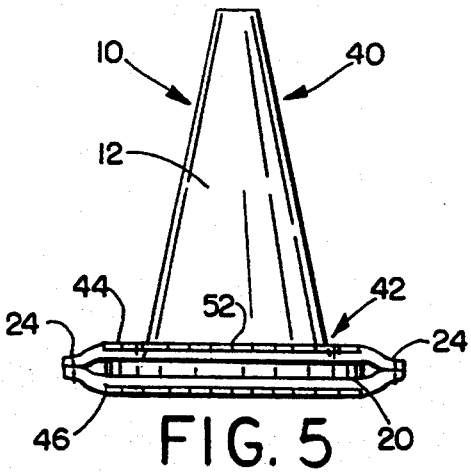
FIG. 5

TREAD BALLAST OR WEIGHT FOR TEMPORARY TRAFFIC CONTROL DEVICES AND POSTS

FIELD OF THE INVENTION

This invention relates generally to ballasts or weights made out of recycled tire tread sections for ballasting temporary traffic control devices used in guiding and directing the flow of traffic and otherwise indicating the presence of road and construction sites, and for ballasting posts and other such devices.

BACKGROUND OF THE INVENTION

Many different types of temporary traffic control devices are well known. One typical device is a traffic cone which includes an upstanding inverted conical portion and a relatively heavy base. Generally these devices are molded as a single piece of high visibility plastic.

To improve the resistance of such a temporary traffic control device to being blown over or moved by the force of wind generated by a moving vehicle or weather conditions, a weight is sometimes dropped over the upstanding portion to lie on the base of the device, thus increasing the overall weight of the device. Such weights have been formed from metal or relatively dense plastic as well as fashioned from sidewalls of discarded tires, for example, One problem with conventional metal or plastic weights is their relatively high cost. Weights fashioned from sidewalls of discarded tires are relatively inexpensive, but the size of the tires places undue restrictions on the size and type of device they can be used with.

SUMMARY OF THE INVENTION

The present invention provides ballasts or weights made out of tread sections of used car or truck tires which may be used to provide bases or weights for traffic control devices as well as posts and other devices of different sizes and shapes. A device employing a base made from tire tread sections offers the advantages of a two-piece design with a base that is virtually indestructible. In the event the upright portion of a two-piece traffic control device or post is damaged, the base can be reused and only the upright portion then needs to be replaced. The weights made from tire tread sections offer the advantages of being inexpensive and readily adaptable for use with devices of different sizes and shapes.

In accordance with one aspect of the invention, the weight for a temporary traffic control device or post or other device includes a plurality of tire tread sections fastened together with a hole provided therein for receiving an upright portion of the device.

In accordance with another aspect of the invention, the weight comprises upper and lower portions, each portion including two tire tread sections oriented adjacently with the seam between the tire tread sections of the upper portion running substantially orthogonally to the seam between the tire tread sections of the lower portion, the upper and lower portions being fastened together and having an opening extending therethrough so that the weight may be inserted over the upright portion of the device. The tread sections of the upper and lower portions desirably face away from each other or outwardly.

In accordance with another aspect of the invention, the weight includes upper and lower portions, each portion including a section of a tire tread, the upper and lower portions being fastened together with the outer surfaces of the tire tread sections facing away from each other or outwardly and having an opening extending therethrough so that the weight may be inserted over the upright portion of the device.

In accordance with a further aspect of the invention, the weight includes a plurality of tire tread sections fastened together to define an open area between the tire tread sections, the open area being of a size to be insertable over the upright portion of the device and to engage the base of the device.

In accordance with a still further aspect of the invention, the weight includes a length of tread section having plural openings, each opening sized to receive a leg of an A-frame traffic barricade therethrough, the openings being spaced to permit the legs of the A-frame to be inserted therethrough when in a partially closed position and to maintain the tire tread section at a distance up the legs of the A-frame when the A-frame is in a more open position.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF TEE DRAWINGS

In the annexed drawings:

FIG. 1 is a schematic side elevation view of one form of tread ballast or weight in accordance with the present invention shown providing a removable base for a cone type temporary traffic control device;

FIG. 2 is a schematic perspective illustration of the cone of FIG. 1 with the weight/base removed;

FIG. 3 is a schematic perspective illustration of the weight of FIG. 1 which may be used in conjunction with the cone as shown in FIG. 1 to serve as a base, or as a supplemental weight or ballast for a conventional traffic cone or other device;

FIG. 4A is a reduced schematic illustration of a vehicle tire showing the area of the tire from which a tire tread section may be cut to form a portion of the weight shown in FIG. 3;

FIG. 4B is a schematic illustration of a section of tire tread cut from the tire shown in FIG. 4A;

FIG. 5 is a schematic side elevation view of another form of tread ballast or weight in accordance with this invention shown providing a non-removable base for a temporary traffic control device;

FIG. 6A is a schematic illustration of one of the tire tread sections used to make the tread ballast or weight shown in FIG. 5;

Figure 8:
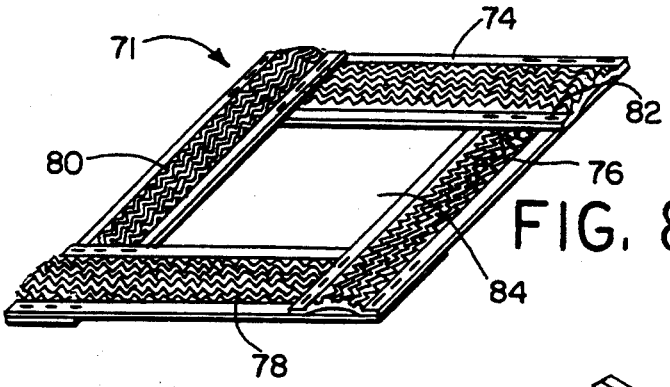
Figure 10:
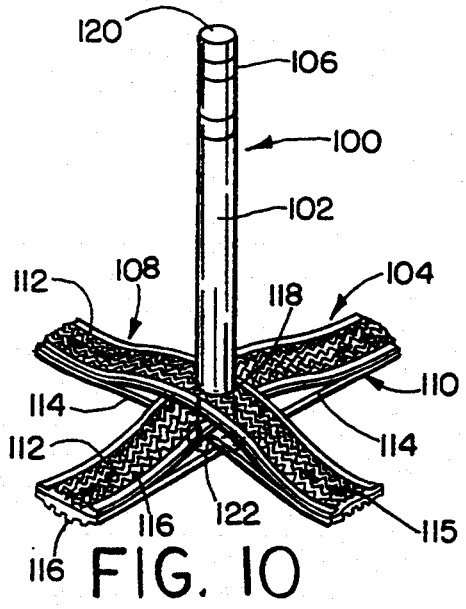
Figure 9:
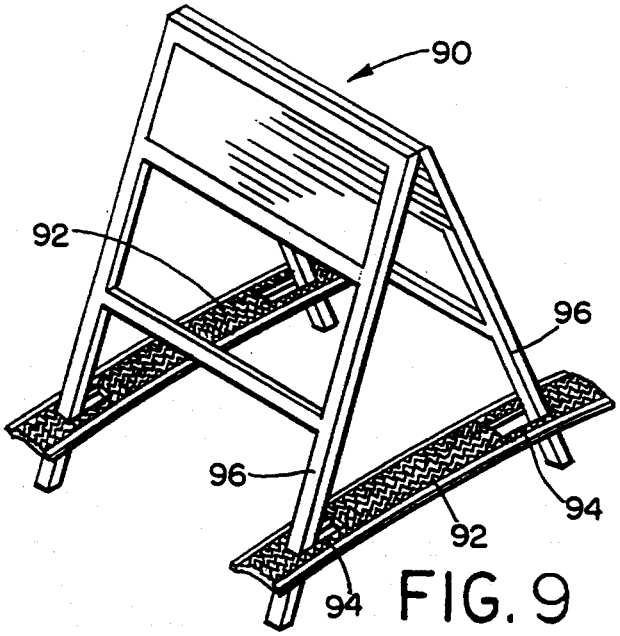

FIG. 8 is a schematic perspective illustration of yet another form of tread ballast or weight in accordance with this invention which may also be used as a base or weight for a temporary traffic control device; and FIGS. 9 and 10 are schematic perspective illustrations of other forms of tread ballasts or weights in accordance with this invention shown used in conjunction with different types of temporary traffic control devices or posts.

DETAILED DESCRIPTION OF THE PREFERRED EMBODIMENTS

With reference to the drawings, and initially to FIGS. 1 through 3, there is shown a temporary traffic control device 10 including a hollow upstanding portion 12 and a base or weight 14 made out of used tire tread sections as described hereafter. The upstanding portion 12 shown is in the form of an inverted cone having an upper end 16 and lower end 18. A relatively narrow shoulder 20 projects radially outwardly from the lower end 18 to form a surface for engagement by the base or weight 14. The cone 12 and shoulder 20 are preferably molded as one piece from a relatively durable and resilient plastic, such as polyethylene or vinyl plastisol.

The base or weight 14, as shown in detail in FIG. 3, is made out of a plurality of tire tread sections 22 which are fastened together such as by the use of staples 24 or some other suitable fastener including, for example, rivets, bolts or adhesives, to provide a ballast for the device 10 of a desired weight. The base or weight 14 shown in FIG. 3 includes upper and lower portions 26 and 28, each including two tire tread sections 22 placed adjacent one another. The upper and lower portions 26, 28 are shown oriented with the seams 29 formed between the tire tread sections 22 of the upper and lower portions 26, 28 running generally orthogonally (at right angles) to one another. Consequently, the four tire tread sections 22 may be fastened together into a single base or weight 14 by fastening each of the tread sections of the upper portion 26 to,each of the tread sections of the lower portion 28.

A hole 30 is provided through the tire tread sections 22 of the base or weight 14 so that the base or weight may be inserted over the upright portion 12 of the device 10. The hole 30 in the base or weight 14 should be sized to permit the base or weight 14 to slide over the upright portion 12 toward its lower end 18 and to come to rest on the shoulder 20. The size of the hole 30 may be chosen so that the base or weight 14 grips the outer surface of the cone 12 adjacent the lower end 18 thereby creating a degree of resistance to the base or weight 14 being separated from the cone. The hole 30 in the base or weight 14 may be formed, such as by cutting or boring, before or after the tread sections 22 are assembled.

By way of example, the tread sections 22 may be approximately 16 inches in length and approximately 8 inches in width, and may be cut from an automobile or truck tire 32, such as shown in FIG. 4A. The area of the tire 32 from which one such tire tread section 22 has been removed is illustrated in FIG. 4A by reference numeral 34. When the tread sections 22 are cut to provide a portion of the hole 30 prior to the base or weight 14 being assembled, each tread section 22, as shown in FIG. 4B, may be cut with a half circle 36 having a radius of approximately 4 to 4½ inches so that when two tire tread sections are placed side-by-side with the two half circles 36 forming a complete circle, the adjacent tread sections will provide a hole 30 with a diameter of approximately 8 inches. Preferably, the tire tread sections 22 of the upper and lower portions 26, 28 are fastened together so that the outer tread 38 of the tire tread sections in both portions 26, 28 face outwardly, or away from each other. When fastened together in this manner, the tire tread sections 22 function to resist the base or weight 14 from assuming the natural curve of the tire tread sections 22 thus causing the base or weight to be relatively flat.

A base or weight 14, such as described above, may also be used as a supplemental weight for a conventional traffic cone or other temporary traffic control device or post with the hole 30 sized to accommodate a portion of the device upon which it will be used as a supplemental weight or ballast.

In another embodiment, shown in FIG. 5, a temporary traffic control device 40 includes an upstanding portion 12 with a radially outwardly projecting shoulder 20 as described above relative to FIGS. 1 and 2 and a base or weight 42 including two tire tread sections 44 and 46 which secure the shoulder 20 of the upstanding portion 12 therebetween. In this embodiment, a circular hole 56 is cut through each tire tread section 44, 46 or through only the tire tread section which will become the upper tire tread section 44 of the base or weight 42 (see FIG. 6A). The circular hole 56 is sized to fit over the widest portion of the upright portion 12 but to be smaller than the diameter of the shoulder 20. Representative dimensions of the tire tread sections 44 and 46 may be 16 inches in width by 16 inches in length with approximately an 8 inch circular hole 56.

The base or weight 42 is assembled around the shoulder 20 of the device 40 with the upper tire tread section 44 inserted over the upright portion 12 and the lower tire tread section 46 lying below the shoulder 20. The tire tread sections 44 and 46 are then fastened together near their outermost portions, such as by staples 24, to engage the shoulder 20 between the two tire tread sections 44 and 46.

Figure 6B:
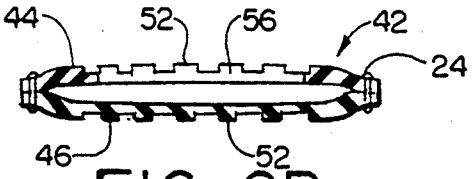
FIG. 6B is a cross sectional view of the tread weight used to provide the base for the traffic control device shown in FIG. 5.

The tire sections 44 and 46 of base or weight 42 are preferably fastened together with the tread 52 of the tire sections facing away from each other or outwardly, as shown in cross-section in FIG. 6B. In this manner, the tire sections 44 and 46, when fastened together, oppose the natural curvature of each tire tread section thus tending to result in a relatively flat base or weight 42. The base or weight 42 is thus securely fastened to the device 40 through the engagement of the tire tread sections 44 and 46 with opposite sides of the shoulder 20 so that the base or weight 42 will not become disengaged from the device 40 during normal use of the device 40. In the event that the upright portion 12, however, is damaged, the upper and lower tire tread sections 44 and 46, respectively, may be unfastened and reused in conjunction with an undamaged upright portion 12 by again fastening together the tire tread sections 44 and 46 around the shoulder 20 of an undamaged device.

Figure 7:
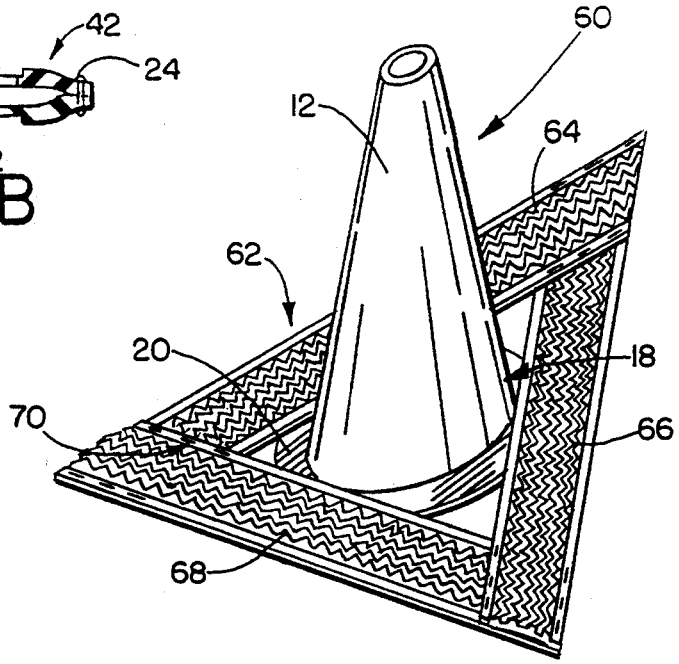
FIG. 7 is a schematic perspective illustration of still another form of tread ballast or weight in accordance with this invention shown providing a weight or base for a temporary traffic control device.

FIG. 7 illustrates another embodiment of a temporary traffic control device 60 including a base or weight 62 and an upright portion 12 having a shoulder 20. In this embodiment, the base or weight 62 is made from three lengths of tire tread 64, 66 and 68 which are fastened together, such as by staples 70, in triangular fashion including three sides to define a triangular open area 72 between the tire tread sections. The tire tread sections 64, 66 and 68 may be cut from a tire, such as shown in FIG. 4A, and may resemble the tire tread sections 22 shown in FIG. 4B without the semicircular holes 36 cut therein. The lengths of the tire tread sections 64, 66 and 68 employed defines the size of the open area 72 therebetween. The open area 72 should be of such a size that the base or weight 62 may be inserted over the top of the upright portion 12 to rest upon or engage the shoulder 20. If desired, the open area 72 may also be sized to engage the sides of the lower end 18 of the cone 12 to resist separation of the cone and the base or weight 62.

The tire tread sections may also be configured in other geometries, for example in a square configuration to provide a four-sided base or weight 71 shown in FIG. 8. This base or weight 71 includes four tire tread sections 74, 76, 78 and 80 fastened together by staples 82 or some other equivalent fastener in a square thereby defining a square open area 84. The square open area 84 is also of a size as defined by the lengths of the tire tread sections 74, 76, 78 and 80 used, and should be sized so that the base or weight 71 may be inserted over the upright portion 12 of a device 10 to engage the shoulder 20.

Other geometries of a base or weight may be employed with those geometries preferably having a peripheral shape which resists roll of the base or weight and device when overturned. Also, additional tire tread sections may be secured to the undersides of the tire tread sections 64, 66 and 68 or tire tread sections 74, 76, 78 and 80 with the treads of the tire sections preferably facing away from each other or outwardly similar to the tread sections 22 shown in FIGS. 1 and 3 and tread sections 44, 46 shown in FIGS. 5 and 6C.

Another temporary traffic control device in the form of an "A" frame traffic barricade 90 is shown in FIG. 9 having a number of tire tread sections 92 for ballast. The tire tread sections 92 each include a pair of slot like openings 94 through which legs 96 of the traffic barricade 90 may be inserted. The pair of slots 94 in each tire tread section 92 are spaced to permit two legs 96 of the A frame 90 to be inserted therein when the A frame 90 is in a partially closed position and to maintain the tire tread sections 92 at a distance above ground level when the A frame is in a more open position as schematically shown in FIG. 9. Consequently, when the A frame 90 is opened as fully as permitted by the space between the slots 94, the tire tread sections 92 are elevated above the ground level and act as a weight or ballast upon the legs 96 of the barricade 90. The tire tread sections 92 thus add weight to the barricade to prevent the barricade from moving or tipping over and advantageously add that weight near the bottom of the traffic barricade 90 therefore lowering the center of gravity of the barricade. Additional tire tread sections may also be secured to the undersides of the tire tread sections 92 in substantially the same manner and for substantially the same purpose previously described.

Another form of temporary traffic control device or post 100 is shown in FIG. 10 including a pole 102 and a base or weight 104 for supporting the pole 102 in an upright orientation. The pole 102 may be made of a high strength, resilient plastic material, such as polyethylene, and may include means such as reflective tape 106 for improving the visibility of the pole 102 for use as a traffic delineator or as a post for supporting plastic fencing used to delineate a construction site.

The base or weight 104 is constructed of two interlaced legs 108, 110 each including two tire tread sections 112 and 114 oriented generally perpendicular to one another. The lengths of tire tread sections 112, 114 may be cut from a tire as illustrated in FIG. 4A. One of the lengths of tire tread sections 112 and 114 of each leg 108 and 110 preferably extends between the lengths of tire tread sections 112 and 114 of the other leg, and such tire tread sections 112 and 114 of each leg 108, 110 are preferably fastened together by staples, rivets or bolts 115 in a stacked relationship with the outer tread 116 of the tire tread sections of each leg facing outwardly or away from each other. A hole 118 is provided through the region of the base or weight 104 where the legs 108 and 110 are interlaced. The hole 118 is sized so that the base or weight 104 can be dropped over the top 120 of the pole 102 but will be retained by a shoulder or enlarged portion 122 at the bottom end of the pole. To support a 3½ to 4 foot pole 102, suitable lengths for the tire treads 112, 114 would be approximately 26 inches and an exemplary weight for the base or weight 104 would be approximately 15 pounds.

Although the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the claims.

What is claimed is:

1. A weight or ballast for a temporary traffic control device or post comprising a plurality of tire tread sections fastened together to provide a generally planar structure, said structure having an opening the axis of which is substantially perpendicular to the general plane of said structure, said opening being of a size to permit said structure to be inserted over an upstanding portion of a traffic control device or post.

2. The weight of claim 1 wherein said tire tread sections have outer treads, and at least two of said tire tread sections are fastened together with the respective outer treads facing outwardly away from each other.

3. The weight of claim 1 wherein said opening is formed by a hole extending substantially perpendicular through at least one of said tire tread sections.

4. The weight of claim 1 wherein said tire tread sections are fastened together to define said opening extending substantially perpendicular between said tire tread sections.

5. The weight of claim 4 wherein there are at least three of said tire tread sections fastened together in a generally triangular configuration to provide a generally triangular shape opening.

6. The weight of claim 4 wherein there are at least four of said tire tread sections fastened together in a generally rectangular shape to provide a generally rectangular shape opening.

7. The weight of claim 1 wherein said tire tread sections are interlaced to provide overlapping portions fastened together, said opening being formed by a hole extending substantially perpendicular through said overlapping portions.

8. The weight of claim 7 which includes a pair of legs oriented generally 90° to each other, each of said legs including two of said tire tread sections, one of said tire tread sections of each leg extending between the tire tread sections of the other leg.

9. The weight of claim 8 wherein the tire tread sections of each leg include outer treads facing outwardly away from each other.

10. The weight of claim 1 which includes upper and lower portions each including two of said tire tread sections, said tire tread sections of said upper portion being fastened to said tire tread sections of said lower portion.

11. The weight of claim 10 wherein said tire tread sections of said upper portion are oriented 90° relative to said tire tread sections of said lower portion.

12. The weight of claim 11 wherein said opening extends through an axial center of said upper and lower portions.

13. The weight of claim 12 wherein said opening is formed by cutting out half circles in abutting edges of said tire tread sections in each of said upper and lower portions.

14. A temporary traffic control device or post comprising an upstanding portion having an upper end and a lower end, a shoulder at said lower end, and a weight for said device or post, said weight comprising a plurality of tire tread sections fastened together to provide a generally planar structure, said weight having an opening the axis of which is substantially perpendicular to the general plane of said structure, said opening being of a size to permit said structure to be inserted over said upstanding portion.

15. The device of claim 14 wherein said weight comprises at least two of said tire tread sections fastened together in alignment with each other, said opening extending through at least one of said tire tread sections.

16. The device of claim 15 wherein said upright portion extends through said opening in said one tire tread section with said one tire tread section engaging one side of said shoulder, and the other tire tread section engages the opposite side of said shoulder.

17. The device of claim 16 wherein said opening only extends through said one tire tread section.

18. The device of claim 16 wherein said opening extends through both of said tire tread sections.

19. The device of claim 14 wherein said upright portion is a pole, said opening in said weight being insertable over said pole to cause said weight to engage said shoulder and provide a base for supporting said pole in a generally upright position.

20. The device of claim 19 wherein said tire tread sections are interlaced together in overlapping relation, said opening extending substantially perpendicular through overlapping portions of said tire tread sections.

21. The device of claim 20 wherein selected ones of said tire tread sections are oriented generally orthogonally with respect to other ones of said tire tread sections.

22. A traffic delineator comprising a pole, and a base for supporting said pole in a generally upright position, said base including a plurality of overlapping tire tread sections fastened together, and a hole extending generally perpendicular through overlapping portions of said tire tread sections for receiving said pole.

23. The delineator of claim 22 wherein said tire tread sections are interlaced together in overlapping relation, said opening extending through interlaced portions of said tire tread sections.

24. The delineator of claim 22 wherein selected ones of said tire tread sections are oriented generally orthogonally with respect to other tire tread sections.

25. A temporary traffic control device comprising an A frame traffic barricade having a plurality of legs, a length of tread section having a pair of spaced apart openings therein, each opening sized to receive a leg of said barricade therethrough, the openings being spaced to permit two legs of the barricade to be inserted therethrough when in a partially closed position and to maintain the tire tread section at a distance up the legs of the barricade when the barricade is in a more open position.

26. The device of claim 25 wherein the openings in said tire tread section are in the shape of a slot.

* * * * *